United States Patent [19]

Enemark

[11] 4,186,390

[45] Jan. 29, 1980

[54] BATTERY POWERED SMOKE DETECTOR

[75] Inventor: Robert B. Enemark, Duxbury, Mass.

[73] Assignee: Electro Signal Lab, Inc., Rockland, Mass.

[21] Appl. No.: 872,674

[22] Filed: Jan. 26, 1978

Related U.S. Application Data

[63] Continuation of Ser. No. 718,686, Aug. 30, 1976, abandoned.

[51] Int. Cl.[2] ..... G08B 17/10

[52] U.S. Cl. ..... 340/630; 250/574; 340/636

[58] Field of Search ..... 340/628, 629, 630, 636; 250/574, 573, 575; 356/207, 438

[56] References Cited

U.S. PATENT DOCUMENTS 3,316,410 4/1967 Meili et al. ..... 340/630

3,946,241 3/1976 Malinowski ..... 340/629

*Primary Examiner*—John W. Caldwell, Sr.
*Assistant Examiner*—Daniel Myer

[57] ABSTRACT

A scatter type of smoke detector wholly supplied by a dry cell battery includes a clock circuit applying energy pulses to an LED light source which directs light pulses on a smoke sensing path. Light pulses scattered by smoke generate detection pulses in a photo diode whose amplitude is dependent on the smoke density. The clock pulses and detection pulses are applied to a control circuit including a dual, data-type flip-flop logic circuit and a threshold circuit driving an alarm horn. If the smoke density, and hence the detection pulse amplitude, exceeds a predetermined level the control circuit energizes the alarm in a continuous mode. If the battery drops below a preselected level the control circuit is actuated in an intermittent mode.

15 Claims, 1 Drawing Figure

BATTERY POWERED SMOKE DETECTOR

Figure 1:
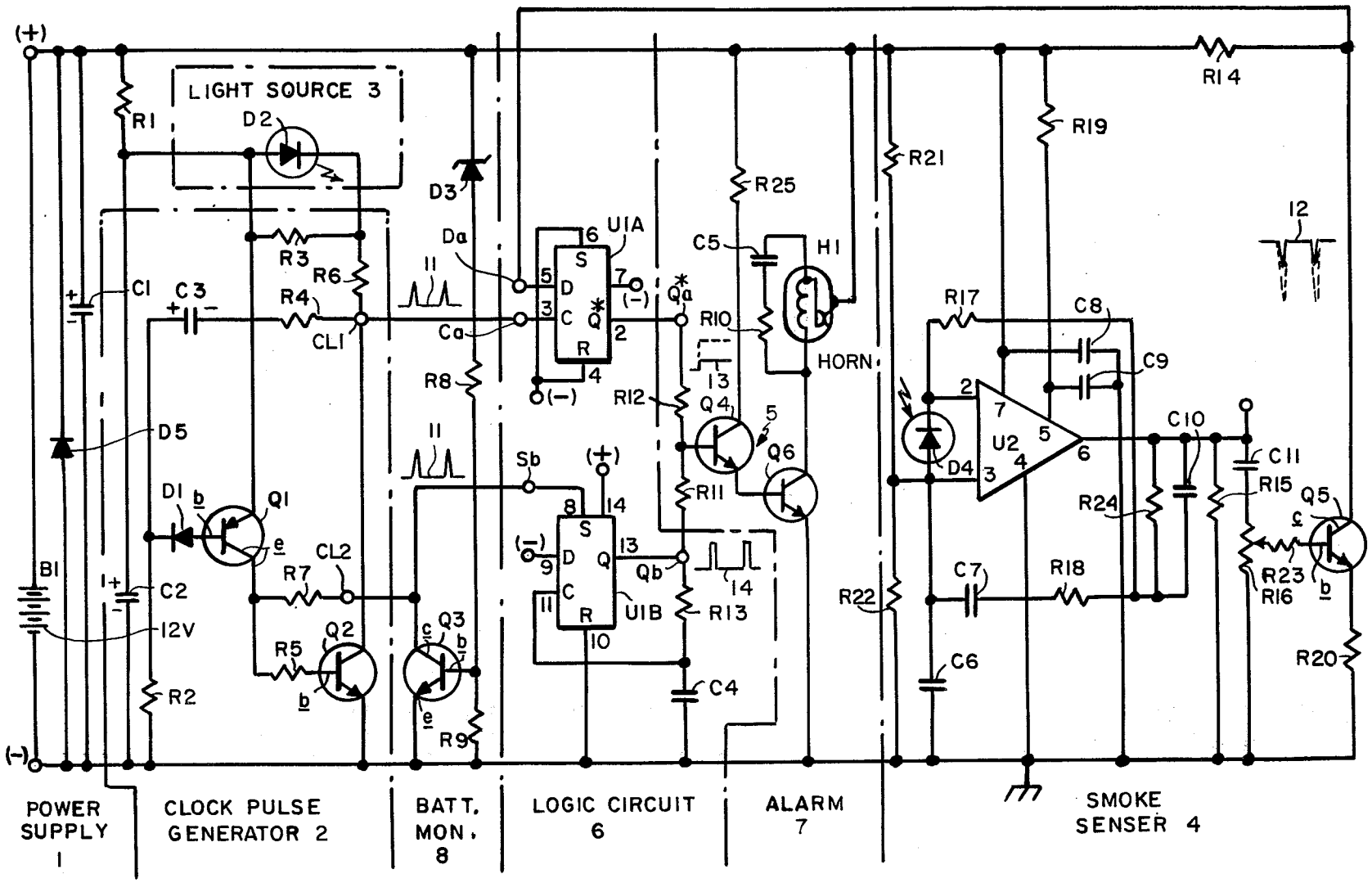

This is a continuation, of application Ser. No. 718,686, filed Aug. 30, 1976, abandoned.

BACKGROUND OF THE INVENTION

Smoke detectors powered from an alternating current line are inherently subject to failure if the line loses power. Battery powered detectors avoid line failure problems, have a naturally simple power supply which is adequate to energize LED light sources, and for these and other reasons are becoming desirable and advantageous. Battery life can be prolonged by energizing the light source periodically for short times by applying energy pulses to the source as shown in U.S. Pat. No. 3,846,773. But pulsing the light introduces the problem of distinguishing pulses of light scattered by smoke from pulses induced in the detector circuitry by electrical surges or noise spikes in external wiring or the environment. An additional problem is that a single induced pulse might trigger a false smoke alarm which cannot thereafter be terminated by the detector circuitry.

Accordingly one purpose of the present invention is to discriminate between noise spikes and smoke detection pulses in a pulsed, battery smoke detector of the scatter type. A further object is to provide control circuitry for the alarm which will terminate a false alarm initiated by noise. Yet another object is to employ a pulse generator both for energizing the light source and sounding an alarm in an intermittent mode distinct from that of the smoke alarm mode.

STATEMENT OF INVENTION

According to the invention an electrical circuit for an optical detector of smoke or other fluid borne light scattering matter comprises a source of pulsed light directed on a smoke sensing path, photoelectric means responsive to pulsed light to generate electrical detection pulses, clock means periodically producing electrical clock pulses energizing the light source, and a control circuit coupled to the clock means and receiving clock pulses and detection pulses respectively therefrom, wherein the photoelectric means responds to light from the source increasingly scattered by matter increasing to a predetermined density to generate detection pulses of predetermined amplitude, and wherein the control means includes means responsive to coincident receipt of said clock and detection pulses to convert detection pulses of greater than predetermined magnitude into an alarm signal having the same duration as the clock period, the control circuit being responsive to subsequent clock pulses and a coincident detection pulse of less than predetermined amplitude to terminate the alarm signal.

DRAWING

FIG. 1 is a schematic diagram of a battery powered, scatter type of smoke detector according to the invention.

DESCRIPTION

General Operation

Battery Power Supply 1

Battery Monitor Circuit 8

Clock Circuit 2

Smoke Senser 4

Alarm 7

Logic Circuit 6

General Operation—FIG. 1

An example of the invention is shown schematically in the single FIGURE wherein a clock 2 controls transmission of energy from a power supply 1 to light source 3. The primary object of the invention is to detect a change in the scatter of light from the source 3 to a senser 4 matched to the form of energy of the source. In an optical smoke detector with light as the source 3, the senser 4 is a photoelectric device preferably responsive to the predominant wavelengths of the light source. Smoke, for example, scatters light from the source 3 to the senser 4 as fully described in U.S. Pat. No. 3,723,747. The clock 2 controls transmission of periodic power pulses 11 of energy to the light source 3 and also to a logic circuit 6. When a change in ambient physical condition affects propagation of energy from the source 3 to the senser 4 the senser will detect the change by generating pulses 12 having the same repetition rate as the clock pulses 11. These condition detector pulses 12 are also applied to the logic circuit 6 in close synchronism with the clock pulses 11. The logic circuit is a dual, data type flip-flop responsive to the two coincident input pulse trains 11 and 12 so as to put out an actuating signal to an alarm 7.

The figure shows a specific example of the invention embodied in scatter type of optical smoke detector whose power supply 1 is a battery B1. The battery supplied power to a clock 2 as well as to a light emitting diode (LED), a photodiode D4 and a smoke sensor 4, two parts (U1A and U1B) of a coincidence logic circuit 6, an alarm 7 with a horn H1 and a battery monitoring circuit 8. 120 microsecond duration clock pulses 11 occurring at 10 second periods cause the LED to emit short flashes of light in a dark chamber such as is shown in U.S. Pat. No. 3,863,076. In the absence of smoke, and also if the battery monitor 8 senses a predetermined adequate voltage across the battery B1, the logic circuit transmits no actuating signal to the alarm 7. Smoke in the dark chamber will scatter light to the photodiode D4 and transmit detection pulses to the coincidence logic circuit 6 at the same repetition rate as the clock pulses.

In response to such coincident input of clock pulse 11 and detector pulses 12 part U1A of the logic circuit continuously actuates the alarm circuit. But, if the battery monitor circuit 8 senses a drop in the battery voltage below a predetermined level indicating an impending battery failure, the monitor circuit will enable input of a clock pulse to the second part U1B of the logic circuit, which input causes the logic circuit to initiate a trouble signal to the alarm 7 sounding the horn. The trouble signal is also fed to the flip-flop back through a time delay network R13-C4 ending the trouble signal after a brief (e.g., 50 millisecond) period. The trouble signal thus sounds the horn momentarily every 10 seconds at the clock rate in a mode easily distinguishable audibly from the continuous sounding of the horn when smoke is detected.

Battery Power Supply 1

FIG. 1 shows schematically one form of smoke detector circuit suitable for use in a detector structure such as is shown in U.S. Pat. No. 3,863,076. The power supply 1 comprises a 12 volt battery B1 such as a P. R. Mallory & Co., Inc. No. 304116 mercury cell having a positive (+) and negaative (−) terminal. A 500 microfarad electrolytic capacitor C1 and a 100 microfarad electrolytic capacitor C2 store energy from the battery for quick release to other circuits. A diode D5 protects the circuits from damage by battery reversal.

Battery Monitor Circuit 8

The voltage supplied by the battery B1 is sensed by a battery monitor circuit. The battery rating is such that it may be expected to supply adequate current to the detector circuits for somewhat over 600 milliampere hours and then decline. A decline to between 10 and 11 volts indicates the beginning of battery end life. The battery monitor circuit 3 includes a 10 volt zener diode D3, resistor R8 (nominally 390 kilohms) resistor R9 (470 kilohms) and a transistor Q3 (2N3414). The diode and resistors are in series across the battery terminals (+) and (−), the junction of resistor R8 and R9 being connected to the base b of the monitor transistor Q3. Resistor R8 may be adjustable or selected such that above a predetermined significant battery voltage (e.g., 10.5 volts) the junction voltage holds the transistor Q3 conducting, so that pulses from the clock 2 at its emitter e are shunted to ground rather than being transmitted to the logic circuit 6 through a 470 kilohm resistor R7. However, when the battery approaches end life by decline to the predetermined significant level (e.g., 10.5 volts), the voltage at the base b of the monitor transistor Q3 drops below cut-off for the transistor which ceases conducting and allows clock pulses to be transmitted to the coincidence logic circuit 6 as will be more fully explained.

Clock Circuit 2

The clock circuit 2 is an astable, asymmetrical multivibrator with two transistor stages Q1 (2N2907) and Q2 (2N3704) whose period or pulse repetition rate of about 10 seconds is primarily determined by the timing of a 1 microfarad capacitor C3 and an 18 megohm resistor R2. Capacitor C3 is charged from capacitor C2 through the emitter e and base b circuit of transistor Q1 (2N2907) diode D1 (1N4454), resistor R4 (22 ohms) and the collector c to emitter e circuit of transistor Q2. With both clock transistors Q1 and Q2 conducting a clock voltage pulse appears at the clock outputs CL1 and CL2, and operating current is drawn by the LED light source D2. The 120 microsecond duration of each pulse is approximately determined by the time constant of the above described charging circuit.

Discharge of the clock capacitor C3 begins when its charge approaches the battery voltage, less other voltage drops in the charging path, and current through the transistor Q1 drops. Current through resistor R5 (100 ohms) to the base b of transistor Q2 is then reduced and by regenerative action both transistors Q1 and Q2 are abruptly cut off. This abrupt transition terminates the clock pulse and illumination of the LED.

The time constant of the 10 second interval between pulses, or its inverse the pulse repetition rate, is determined by the discharge path of the 1 microfarad capacitor C3 and 18 megohm resistor R2, and the small values of resistors R3 (330 ohms), R4 (22 ohms) and R6 (7.5 ohms).

Smoke Senser 4

The smoke sensing circuit 4 properly includes an infrared LED light source D2 (RCA Type SG 1010A) which, however, is shown for simplicity above the clock 2. As is too well known to warrant detailed description, light from the LED D2 is directed by lenses, barrels or masks on a path in a nearly dark chamber with smoke entrances. Smoke in the light path scatters the light to a predominantly infrared sensitive silicon photodiode D4 (Vactec, Inc., Type VTS 4085). In a scatter type smoke detector, as compared with an obscuration type, light scattered to the photodiode or other cell D4 increases as the density of smoke increases. Such density is expressed in percentage reduction in light intensity by one foot of smoke, or percent smoke, for short. Presently 2% smoke is broadly established as the predetermined density at which a smoke alarm should be given in residences, although alarm at somewhat lower levels is acceptable.

At less than alarm density smoke will scatter lower intensities of light. The anode of photodiode D4 is held by voltage divider resistors R21 (6.8 megohms) and R22 (2.2 megohms) at a level suitable for input to a micropower operational amplifier U2 which converts the pulsed current output of the photodiode D4 to a voltage pulse each time the LED D2 is pulsed.

Typical types and values of the operational amplifier U2 and its associated circuit components are as follows:

U2—Type CA 3078T
C6,8,9 and 11—0.047 microfarad
C7—0.022
C10—100 picofarad
R14—100 kilohms
R15 and 24—1 megohm
R17 and 19—10 megohms
R18—33 kilohms
R20—2.2 kilohms
R23—23 kilohms A voltage pulse proportional to smoke density and to the corresponding intensity of light scattered to photodiode D4 appears across a potentiometer R16 (50 kilohms) between the operational amplifier output U2-6 and the base b of voltage inverter transistor Q5 (Type 2N3414). Voltage pulses 12 at the collector c of transistor Q5 are minimal when the smoke density is low, although shown in exaggerated amplitude in solid line. When the smoke reaches or exceeds predetermined density the voltage pulse 12 rather abruptly approaches its negative maximum amplitude (broken line). As will be more fully explained under the caption Logic Circuit 6 a high amplitude detection pulse results in application by the logic circuit 6 of a constant voltage of corresponding amplitude to the alarm circuit 7. The amplitude of the detection pulse can be adjusted by the potentiometer R16 so that a detection pulse at or above a predetermined amplitude corresponding to smoke of a predetermined density will cause an alarm.

Alarm 7

If smoke is absent or at low density the constant voltage transferred by the logic circuit 6 from the smoke senser 4 to the alarm circuit 7 corresponds to a smoke density below predetermined density, the transferred voltage will be below the threshold of the first transistor stage Q4 (2N3414) of the alarm circuit 7. Such a low voltage further divided by resistors R11 (56 kilohms), R12 (56 kilohms), R13 (750 kilohms) and an 0.047 microfarad capacitor C4 holds the transistor Q4 non-conducting, which in turn holds the second alarm transistor Q6 (2N3414) non-conducting. However, when smoke equals or exceeds the predetermined density and the negative going detection pulse 12 correspondingly exceeds the threshold voltage at which the first alarm transistor Q4 conducts, the second alarm transistor completes a circuit through the coil of a horn H1 sounding the horn.

The alarm circuit 7 also includes the following protective or noise suppressing components:

R10 —15 kilohms
R25 —1.5 kilohms
C5 —0.22 microfarads

Logic Circuit 6

In the logic circuit the clock pulses 11 are continually applied through terminals Ca and Sb respectively to the Clock input C of the upper and lower logic U1A and U1B of dual data-type flip-flops (RCA type CD 4013AE). Such dual data flip-flops are described in RCA Solid State '74 Data Book SSD-2038, COS/MOS Digital Integrated Circuits, at pages 68 and 69. The upper flip-flop U1A responds to each clock pulse 11 through terminal Ca to its clock input C by transferring the data or voltage level at its data input D in the same polarity to its output Q, or in the inverse polarity to its output Q*. When the smoke scattered light from the LED D2 to the photodiode D4 is slightly below a predetermined density (e.g. 2% light obscuration per foot) the sensor 4 supplies low, negative going pulses 12 dropping slightly (solid line) from the 12 volt positive level to the data input D of flip-flop U1A. Then when a clock pulse is concomittantly applied to the flip-flop clock input C the inverse, or relatively low negative voltage 13 (solid line) is transferred to the inverse output Q* of flip-flop U1A and maintained at that level until the data input level changes and a clock pulse recurs. Since, as previously explained with respect to the alarm circuit 7, the threshold of alarm transistor Q4 is not reached at low levels, Q4 and Q6 remain non-conducting and the alarm horn H1 is not energized.

If, in the case of an incipient fire, the smoke density is at or above the predetermined level, the senser 4 supplies a more negative going voltage detection pulse 12 (broken line) to the data input D of the upper flip-flop U1A. Accordingly at the coincident arrival of the next clock pulse the higher amplitude pulse will be transferred so that the flip-flop inverse output Q* will carry a voltage 13 (broken line) above the threshold of the alarm circuit 7, causing the horn H1 to be sounded continuously until the next clock pulse. If at the occurrence of the next clock pulse the data input level is a low amplitude pulse, a voltage 13 (solid line) below the alarm circuit threshold will be transferred to the output Q* of flip-flop U1A, and the alarm circuit will be shut off. Thus a continuous true alarm sounding of the horn H1 requires repeated coincidence of the clock signal and a detector signal corresponding to alarm threshold.

The above described requirement of repeated detection signals at a greater than alarm threshold level permits discrimination against spurious signals which can be induced in the detector circuit by transitory concentration of matter, flashes of ambient light, and particularly voltage surges in building wiring or the atmosphere. With the circuit of the present invention, to produce the distinctive continuous alarm sounding of the horn H1 such spurious pulses must not only occur in the brief (e.g. 10 to 30 microseconds) rise at the beginning of the 120 microsecond interval of the clock pulse, but they must also be of a polarity equivalent to reduction of light or detection pulse voltage and they must repeat exactly at the clock pulse repetition rate of once each 10 seconds. Even an unlikely single spurious pulse occurring in the correct polarity and amplitude and exactly at the beginning of the clock pulse could actuate the horn for only one clock pulse period. At the subsequent clock pulse the absence of the spurious pulse would return the output Q* of flip-flop U1A to non-alarm level. The likelihood of two suitable spurious pulses occurring exactly during successive clock pulse rises is extremely small. The present detector does not latch in an alarm condition as the result of a spurious pulse. To avoid annoyance of a household user or lack of confidence in the smoke detector it is well worthwhile to discriminate against spurious pulses. And yet the present logic circuit does so simply, reliably and in a manner compatible with monitoring the battery power supply and indicating loss of battery voltage adequate for sounding a smoke alarm before the battery voltage becomes too low to warn of impending battery failure. Moreover impending battery failure is signalled by a trouble alarm easily distinguishable from the smoke alarm, and also persisting for a long period, over two weeks, after battery end life begins.

As previously explained under the caption Battery Monitor Circuit 8 the monitor circuit enables transmission of clock pulses from the base b of the monitor transistor Q3 along a trouble signal path including resistor R7 to the logic circuit 6. Specifically the input through terminal Sb to the set terminal S of the lower flip-flop U1b sets this flip-flop with the 12 volt (+) level at its output Q. Assuming no smoke alarm is underway, the 12 volt output raises the base b of alarm transistor Q4 above its threshold, thereby causing transistors Q4 and Q6 to conduct and sound the horn H1. But the rise to the 12 volt level at the output Qb transmits a voltage rise through resistor R13 of the time delay network 9 whose time constant is primarily determined by the value of resistor R13 (750 kilohms) and capacitor C4 (0.047 microfarad) at about 25 to 50 milliseconds. After this brief period the voltage rise is fed back to the clock terminal C of flip-flop U1b, causing transfer of the constant zero or ground voltage at the data terminal D to the output Qb, thereby reducing the base voltage of alarm transistor Q4 below threshold and terminating sounding of the horn. The 25 to 50 millisecond duration of each trouble pulse 14 is distinctly longer than each 120 microsecond clock pulse, but distinctly shorter than the 10 second clock pulse period. The intermittent sounding of the horn in the case of battery end life sounds a trouble signal for 25 to 50 milliseconds each ten second clock period is not only easily distinguishable from the smoke but also uses the same dual flip-flop U1A and B alarm circuit 7, and derives its 10 second interval from the clock 2 which also energizes the LED D2.

It should be understood that the present disclosure is for the purpose of illustration only and that this invention includes all modifications and equivalents which fall within the scope of the appended claims.

I claim:

1. An electrical circuit for an optical detector of smoke or other fluid borne light scattering matter comprising:

a source of pulsed light directed on a smoke sensing path, photoelectric means responsive to pulsed light to generate electrical detection pulses, clock means periodically producing electrical clock pulses energizing the light source, and a control circuit coupled to the clock means and photoelectric means receiving clock pulses and detection pulses respectively therefrom, wherein the photoelectric means responds to increasing scatter of light from the source by matter increasing beyond a predetermined density to generate detection pulses of predetermined amplitude range, wherein the control means includes means responsive to coincident receipt of said clock and detection pulses to convert detection pulses within said predetermined amplitude range into an alarm signal, the control circuit being responsive to subsequent clock pulses and a coincident detection pulse outside said predetermined amplitude range to terminate the alarm signal, and wherein the control circuit includes a data-type flip-flop stage having a clock input for the clock pulses, a data input for the detection pulses and an output carrying a voltage level for each clock period corresponding to the amplitude range of the detection pulse at the beginning of the period.

2. A circuit according to claim 1 wherein the control circuit includes normally non-conducting electronic valve means connected to the logic circuit and responsive to a voltage level output thereof to above a predetermined amplitude to conduct the alarm signal.

3. A circuit according to claim 1 including an electrical alarm.

4. A circuit according to claim 1 including a battery as the sole power supply for the circuit.

5. A circuit according to claim 1 wherein the alarm signal is continuous so long as smoke of the predetermined density is sensed.

6. A circuit according to claim 1 including a battery supply therefor and a monitor circuit sensing the battery voltage and connected to the clock means to receive clock pulses therefrom, the monitor circuit being responsive to decrease of the battery voltage below a preselected level to cause an intermittent trouble signal at the clock repetition rate.

7. A circuit according to claim 6 including an electrical alarm connected to the control circuit and battery monitor circuit and producing a substantially continuous alarm in response to an alarm signal from the control circuit, and producing an intermittent alarm in response to the trouble signal.

8. A circuit according to claim 6 wherein the battery monitor circuit includes a normally conducting electronic valve normally forming a ground connection for the clock, a trouble signal conductor connected intermediate the clock means and monitor valve, and a voltage divider connected across the battery, the monitor valve having a control connected intermediate the voltage divider and responsive to decrease of battery voltage to cease conduction and transfer the clock pulses to the trouble signal conductor.

9. A circuit according to claim 6 including a second data-type flip-flop producing trouble pulses at the clock repetition rate.

10. A circuit according to claim 9 wherein the second flip-flop has a set input connected to the trouble signal conductor and a time delay network connected between its output and its clock input, so that after a clock pulse initiates a pulse rise at the output, the pulse is applied with a time delay to the clock terminal thereby terminating the trouble pulse.

11. A circuit according to claim 10 wherein the time constant of the time delay network is of greater duration than each clock pulse and substantially shorter than the clock period.

12. A smoke detector comprising a light source pulsing at a predetermined rate and means for producing a signal pulse of short duration relative to the interval between pulses in response to the pulsed light under predetermined conditions, a level detector having an input connected to the output of the signal pulse producing means, said level detector producing an output signal only in response to an input signal pulse in a predetermined value range, the output of the level detector being connected to an alarm actuating device, and a self-controlled two-condition switching flip-flop having a first condition in which it is ineffective to actuate an alarm and including means responsive to a pulse from the level detector to shift to a second self-maintained condition in which said two condition flip-flop actuates the alarm actuating device repeatedly at the light pulsing rate substantially longer than the signal pulse duration.

13. A detector according to claim 12 wherein the two-condition flip-flop includes means maintaining the output of the two condition flip-flop in its second condition substantially the whole signal pulse interval.

14. A detector according to claim 13 wherein the maintaining means holds the two-condition flip-flop output in its second condition substantially continuously so long as signal pulses recur at said interval.

15. A detector according to claim 12 including means for applying a clock pulse to the light source, wherein the switching flip-flop has two inputs, one input responding to the clock pulse to enable the other input to respond to a signal pulse.

* * * * *